US005377607A

United States Patent [19]

Ross

[11] Patent Number: 5,377,607

[45] Date of Patent: Jan. 3, 1995

[54] CONVERSION ARRANGEMENT FOR SAIL BOARD WITH SEAT

[76] Inventor: Gerald S. Ross, 24 Cranberry Cir., Mashpee, Mass. 02649

[21] Appl. No.: 207,967

[22] Filed: Mar. 8, 1994

[51] Int. Cl.[6] ..... B63H 25/06

[52] U.S. Cl. ..... 114/39.2; 114/162; 114/363; 440/104

[58] Field of Search ..... 114/39.1, 39.2, 363, 114/144 R, 162; 441/65, 74; 440/104

[56] References Cited

U.S. PATENT DOCUMENTS

| | | | |
|---|---|---|---|
| 4,771,723 | 9/1988 | Friesen | 114/39.2 |
| 5,143,008 | 9/1992 | Hall | 114/39.2 |

FOREIGN PATENT DOCUMENTS

| | | | |
|---|---|---|---|
| 3104301 | 8/1982 | Germany | 114/39.2 |
| 3424653 | 1/1986 | Germany | 114/39.2 |
| 3728596 | 3/1989 | Germany | 114/39.2 |

*Primary Examiner*—Stephen P. Avila
*Attorney, Agent, or Firm*—Thomas A. Kahrl

[57] ABSTRACT

A multi-functional accessory arrangement for converting a sail board into a paddling craft, rowing craft or conventional sailing craft consisting of a sail board hull having a multi-functional seat including an associated back support adapted to be adjustable between a sailing-/hiking position, rowing position and paddling position said seat connected to the sail board hull permitting movement of the seat between a forward position and an aft position, a multi-functional propulsion kit for selectively transforming the sail board into a sail boat, a row boat or a kayak board said kit including a hiking device connected to the chassis for use in counter balancing heeling of the hull responsive to the action of wind acting on the sail, a pedestal console for controlling the movement of the sail board including a centerboard, a manual steering device with rigging for controlling a sail, oar locks for use with oars and boom.

10 Claims, 7 Drawing Sheets

CONVERSION ARRANGEMENT FOR SAIL BOARD WITH SEAT

BACKGROUND OF THE INVENTION

Watercraft sports have become increasingly popular particularly in the areas of wind surfing, sculling and more recently sea kayaking. Wind Surfing requires good balance, upper body strength as well as a strong back and legs and the ability to stand upright for extended periods of time, thus limiting the number of potential participants in the sport. Also, depending on wind conditions and sea conditions, wind surfing typically may require several sizes of sails as well as boards, each of which are costly. Sculling and sea kayaking involve watercraft having a narrow beam. Each require a good sense of balance and accordingly appeal to a limited clientele, specifically those having requisite physical skill. Furthermore, an active person who engages in each of these related watercraft sports, would need a substantial array of equipment to participate, including multiple hulls, masts, ocars, paddles, rigging and sails.

Applicant is aware of prior art devices which have employed seat devices for sail boards as well as conversion devices for converting a sail board assembly into a sailing craft. Such devices include U.S. Pat. No. 5,143,008 (Hall), U.S. Pat. No. 4,771,723 (Friesen), and German patent DE 3123 967 (Horn), German Patent 3424653-A (Mack), German Patent 3343564-A (Scho). These patents disclose inventions for the conversion of a sail board assembly into a sail boat assembly. They also incorporate a seat, typically fixed to the sail board hull and employ sailor controllable steering devices connected to a rudder assemly, to permit a sailor to steer his craft in a selected direction. However most prior art patents covering conversion arrangements for conventional sail boards have failed to provide a central conning console which permits the sailor while seated to control from one station movement of a rudder, movement of a center board and direct the angle of the sail. Furthermore, prior art patents disclosing conversion arrangements generally are limited in the scope of the conversion of the sail board. Typically, they only convert the sail board into a sail boat, or alternatively convert the sail board into a rowboat, or alternatively convert the sail board into a paddle craft.

Accordingly it is the object of this invention to provide an increased scope of use for sail boards to those who prefer to sit while sailing. It is another object of this invention to increase the scope of use of a sail board hull as wind surfing craft, rowing craft and kayak craft. Another object of this invention is to provide greater stability by utilizing larger size conventional sail board hull commonly called "fun boards" as a hull to which a multi-functional seat can be attached in combination with a plurality of kits for converting the sail board selectively into either a conventional sail boat, designed to be operated from the seated position, a rowboat arranged to be operated with sculls having a seat wherein the user faces the aft or a paddling craft, such as a kayak, wherein the user is oriented in the forward position and employs paddles.

It is therefore desirable to provide for an improved conversion arrangement for a wind surf board or a sail board with a unique multi-positional seat system in combination with watercraft kits for converting a sail board selectively into a sail board, a rowing craft or a paddle craft and which overcomes the limitations of the prior art.

SUMMARY OF THE INVENTION

The present invention is directed to a conversion arrangement for a sail board with seat system in combination with a watercraft conversion assembly for selectively converting the sail board into a conventional sailing boat, a rowing craft or alternatively to a paddling craft. In particular the present invention is directed to said seat system installed on the sail board, on which a sailor may sit, in combination with a watercraft conversion assembly including a sailing kit, a rowing kit, and a paddling kit wherein the seat system consists of a multi-positional seat having an associated back support with said seat mounted on a chassis connected to the sail board.

The watercraft conversion assembly of the present invention provides for transforming the sail board into different types of watercraft including a first type of watercraft consisting of a sailing craft, a second type of watercraft consisting of a rowing craft or a third type of watercraft consisting of a paddling craft at the option of the user.

In the present invention, the sail board with seat system, which is common to each of the sailing craft, rowing craft and paddling craft consists of a sail board having a board-like hull having an upper deck surface, a lower bottom surface, a bow end and a stern end. In the present invention, the sail board is a conventional wind surfing board with wind surfing accessories removed such as a dagger board, a rear fin and typical wind surfing hinged fastening apparatus for attaching the mast to the sail board. The board typically is a "fun board" having a an approximate size having a length of 361 cm.(12′), a width of 66 cm. (26″) and a volume of floatation material of 228 liters. The seat system consists of a multi-positional seat having a platform and an associated back support, said back support adapted to be adjustable between a sailing position with the sailor facing forward, a rowing position with the oarsman facing aft and a paddling position with the kayaker facing forward.

In the present invention the chassis is attached to the deck of the sail board in alignment with the longitudinal axis having a pair of rails arranged to engage said platform permitting movement of the multi-position seat along a longitudinal axis of the sail board between forward position and an intermediate mid position and aft position. Also included in the multi-positional seat is a hiking slide apparatus connected to the base for movement of said multi-positional seat in an axis athwart the longitudinal axis of the sail board which permits a sailor to hike out laterally in order to counter balance heeling of the sail board in response to action of the wind acting on a sail installed on said sail board.

The present invention also includes a conversion arrangement for converting the sail board with seat system into a conventional sailing craft by employing components of the sailing kit included as part of the watercraft conversion kit. The sailing kit consists of a sail and boom, together with a pedestal console assembly adapted to be installed in association with a conventional dagger board well of the sail board configured to form a control station and a mast for supporting the sail and boom. Said pedestal console includes means for (a) controlling steering of the craft by a hand operated steering apparatus, (b) controlling the sail by hand and (c) operating the dagger board by hand. Included in the pedestal console is a dagger board operable by hand between a down position for heading into the wind and an up position for increased speed. A hand operated tiller connected by shafting apparatus to a rudder mechanism attached to the stern for steering the craft and tackle for rigging the sail consisting of a halyard rope means and main sheet means including conventional tackle and pulleys. The tiller assembly is mounted on the pedestal console and is connected to a shafting device extending rearward to the rudder mechanism configured for manual operation of the rudder mechanism for steering the sail board when in motion. The main sheet and tackle are connected to the boom connected to the sail for sheeting the sail between a close hauled position and a free position. The rudder mechanism is attached to the stern by a gudgeon shaft connected to a transverse beam connected by shafting to the tiller mounted on a pedestal.

In the preferred embodiment, the seat system is adjusted to a sailing mode for conversion of a sail board into a conventional sailing craft wherein the back rest is moved to an aft position by rotating the back through an arc, the back rest being pivotally mounted on the chassis such that the sailor is positioned facing forward. In the sailing mode, the chassis is adjusted to be in a preset longitudinal position being locked in place on the rails by pins fitted in one of a series of holes, such that the sailor is placed facing forward. Furthermore when in the sailing mode and the position of the chassis is set the hiking slide can be unlocked to be free to slide reciprocally along ways extending athwartships thereby permitting of the seat platform the move perpendicularly to the longitudinal axis of the sail board. In the preferred embodiment, the mast is of conventional wind surfing construction and is supported in a semi-rigid stepping device typically in a plate device having a base plate and two side plates permitting an angular movement of the mast between a port position, a mid position, a second mid position and a starboard position as selected by the sailor responsive to varying wind conditions acting on the sail. Shroud means are provided for supporting the mast in each of the selected positions. In this embodiment, the rudder mechanism includes a retractable rudder mounted on a gudgeon device connected to an actuated arm having an aft an aforeward end. The actuating arm is connected to a lever arm attached to the base of a tiller post mounted on the console pedestal. The tiller, adapted to be manually operated, is connected to the tiller post, said tiller post being rotatably mounted on the side of the pedestal console on sleeve devices. This mounting arrangement permits rotation of the tiller post about a vertical axis, there being a horizontally extending tiller handle fastened to the terminal end of said tiller post. In this embodiment, movement of the tiller handle through a transverse arc in a plane parallel to the deck of the sail board causes corresponding movement of the rudder via a shaft thereby turning the rudder on the gudgeon shaft in a corresponding arc.

In the preferred embodiment, the seat system provides for the seat to be moved to the sailing mode for conversion of the sail board into a conventional sailing craft wherein the back rest is moved to the aft position such that the seated sailor is facing forward. In the sailing mode the chassis is adjusted to be in a fixed longitudinal position and the hiking slide is in a preposition thereby permitting movement of the seat along an athwartships axis transverse to the longitudinal fore and aft axis of the sail board. The rudder mechanism comprises a retractable rudder mounted on a retractable gudgeon device connected to an actuating arm having an aft end and a forward end. The actuating arm is connected to a lever arm attached to the base of the tiller post mounted on the pedestal. The tiller has a vertical shaft mounted on the pedestal console which is supported by sleeve means to permit rotation about a vertical axis, there being a horizontally extending handle fastened to the terminal end of the vertical shaft. In this arrangement, by movement of the handle through a transverse arc causes corresponding movement of the rudder turning on the gudgeon shaft in a corresponding transverse arc.

In an alternate embodiment, the sail board may be converted into a rowing craft by employment of the rowing kit included in the watercraft conversion assembly comprising a pair of oars, each oar positioned respectively in an oar lock attached to an outrigger beam on the platform of the seat system. In this embodiment, the multi-positional seat is moved to the rowing position wherein a pair of oars is provided with each oar positioned respectively in an oar lock. In this position which is a rowing craft mode, the multi-positional seat is shifted with the back rest of the seat in the forward position and the hiking slide being locked in a mid position. Propulsion of the craft is provided by the application of force on the oars, and steering is controlled by the application of varying force on the oars.

In yet a third alternate embodiment, the invention is directed to a paddle craft conversion arrangement for the sail board with seat by application of the paddle kit portion of the conversion arrangement kit. The application of this kit converts the sail board into a paddling craft wherein the seat is placed in the paddling position and the seat is positioned with a back rest in the aft position. In this paddling craft arrangement the seat is locked on the chassis locked at the mid position and the person operating the paddling craft is placed in a forward-facing position. Operation of said paddling craft is provided by a conventional kayak paddle device wherein propulsion and steering of the paddle craft is provided by the application of varying force on said paddle.

In yet another alternate embodiment, the invention is directed to a conversion arrangement for the sail board with seat by application of a sail reef kit. This sail kit provides a means of reefing or shortening the sail constructed in a lateen configuration. The sail kit consists of a triangular sail having a bottom edge connected to a bottom boom and a top edge connected to a bottom boom support and a free edge typically called a leech. The reef member is attached to the free edge by a zipper, wherein the top boom is connected to the mast of the sail board by a halyard member and the bottom boom is connected by a sheet means to the pedestal console. In this embodiment, the reef member consists of a truncated panel of sail material including a zipper track on an inner edge having a top and bottom end said ends being supported by boom extension members.

The present invention provides greater stability by utilizing the larger size conventional sail board hull commonly called a "fun board" as a hull to which can be attached to the watercraft the multi-positional seat in combination with one of the enumerated watercraft kits for selectively converting the sail board into a conventional sail board designed to be operated from the seated position, a row boat arranged to be operated with oars designed to be operated from the seated position facing aft, or a kayak craft wherein the user is oriented in the forward position and the seat is in a fixed position.

The invention will be described for the purposes of illustration only in connection with certain embodiments; however, it is recognized that those persons skilled in the art may make various changes, modifications, improvements and additions on the illustrated embodiments all without departing from the spirit and scope of the invention.

BRIEF DESCRIPTION OF THE DRAWINGS

FIG. 6 is an enlarged fragmentary side view of the seat system arranged on the sail board of FIG. 1 showing the multiple positions that the seat system can be arranged in.

DETAILED DESCRIPTION OF THE PREFERRED EMBODIMENT

Figure 2:
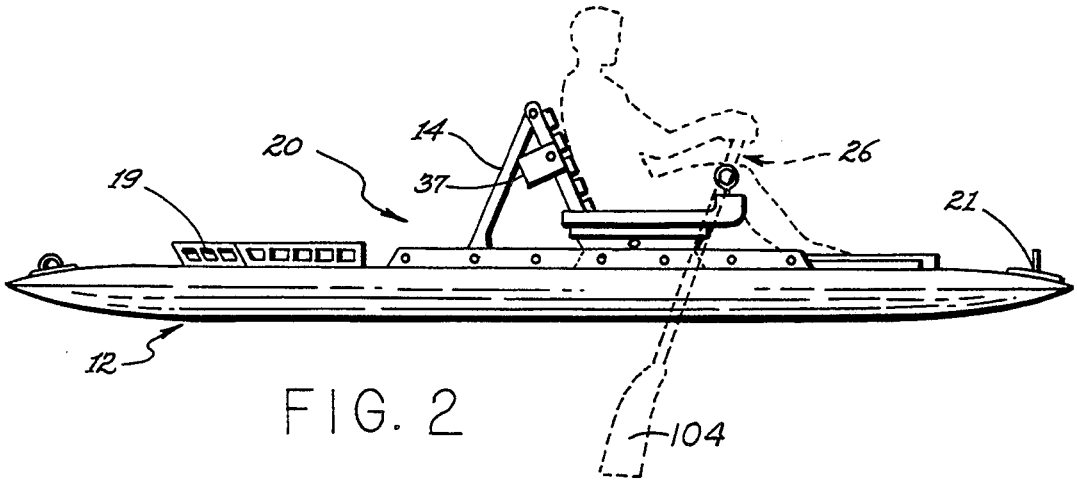
FIG. 2 is a side view of the rowing craft that is an alternate embodiment of the present invention including sail board with seat system shown in the aft facing rowing mode.

Referring to the drawings there is shown a sailing craft 10 consisting of a sail board 12 with seat system 14 and a sailing kit 24 for converting said sail board into said sailing craft, as is shown in FIGS. 4–9. Next, referring to FIG. 2 there is shown a rowing craft 20 consisting of the sail board 12 with seat system 14 and a rowing kit 26 for selectively converting said sail board into a conventional rowing craft 20 as shown in FIGS. 2 and 12. Next, referring to FIGS. 3 and 11, there is shown a paddling craft 22 consisting of the sail board 12 with seat system 14 in combination with a paddling kit 28 for selectively converting said sail board into a paddling craft 22.

Figure 1:
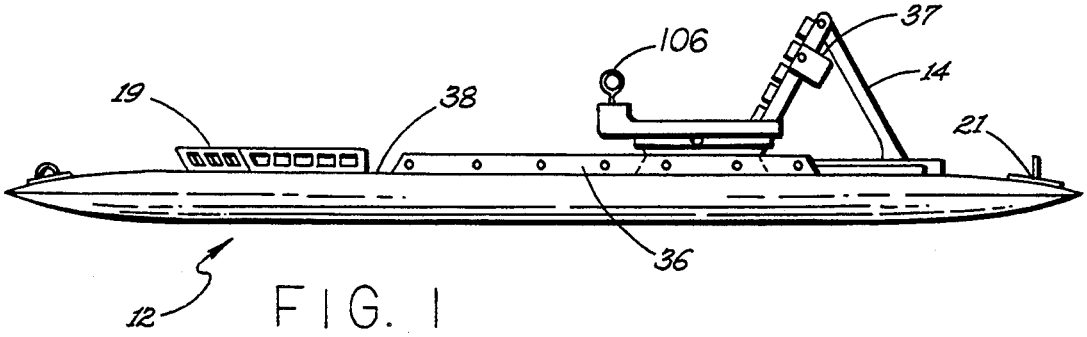
FIG. 1 is a side view of the sail board of the present invention which is shown stripped of all typical wind surfing accessories and including a bow rail, chassis and stern mounting device and includes a seat system.
Figure 4:
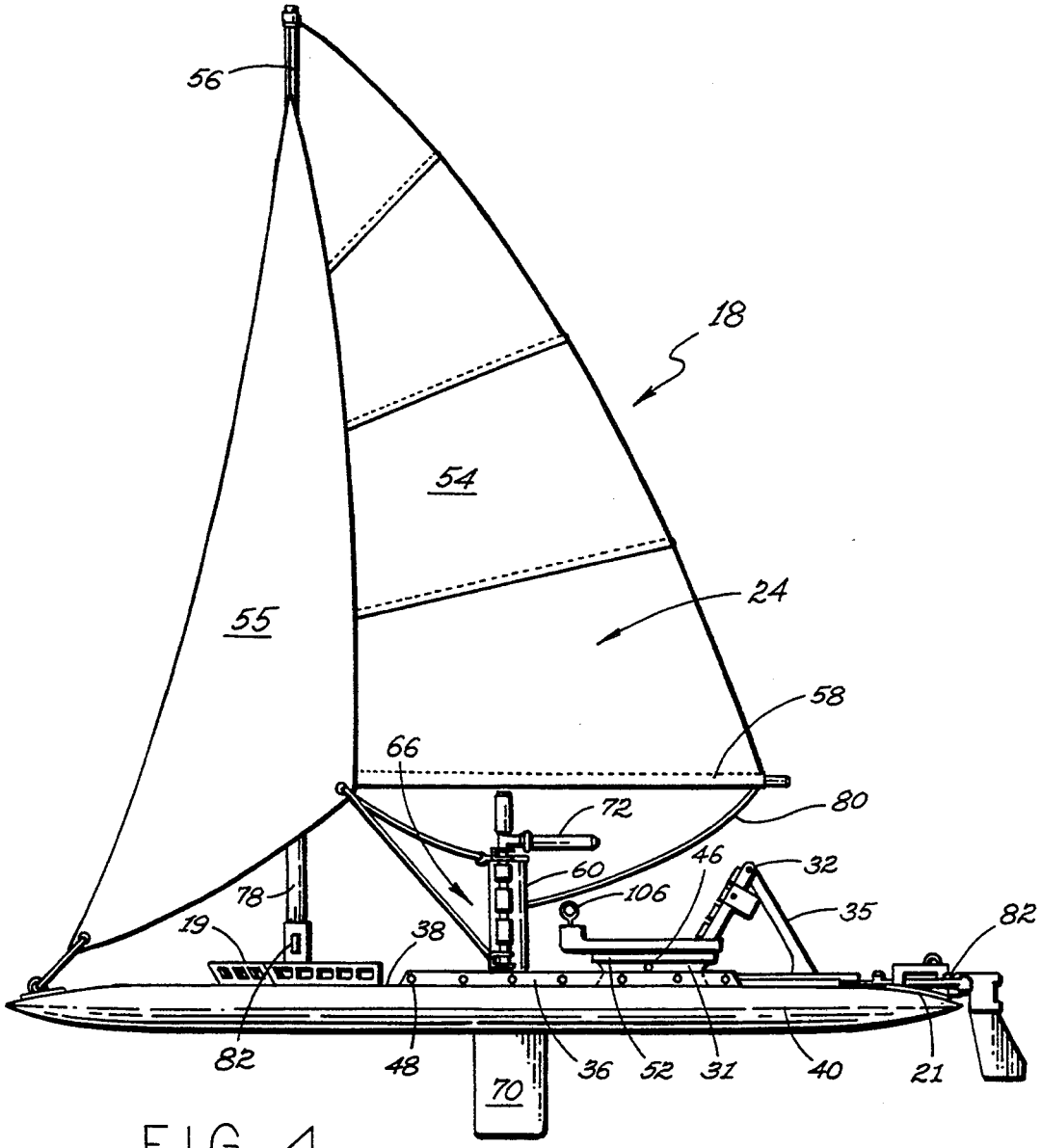
FIG. 4 is a side elevational view of a sail board with seat system in a sail-craft arrangement in accordance with the present invention of FIG. 1, showing a dagger board and a rudder mechanism.
Figure 14:
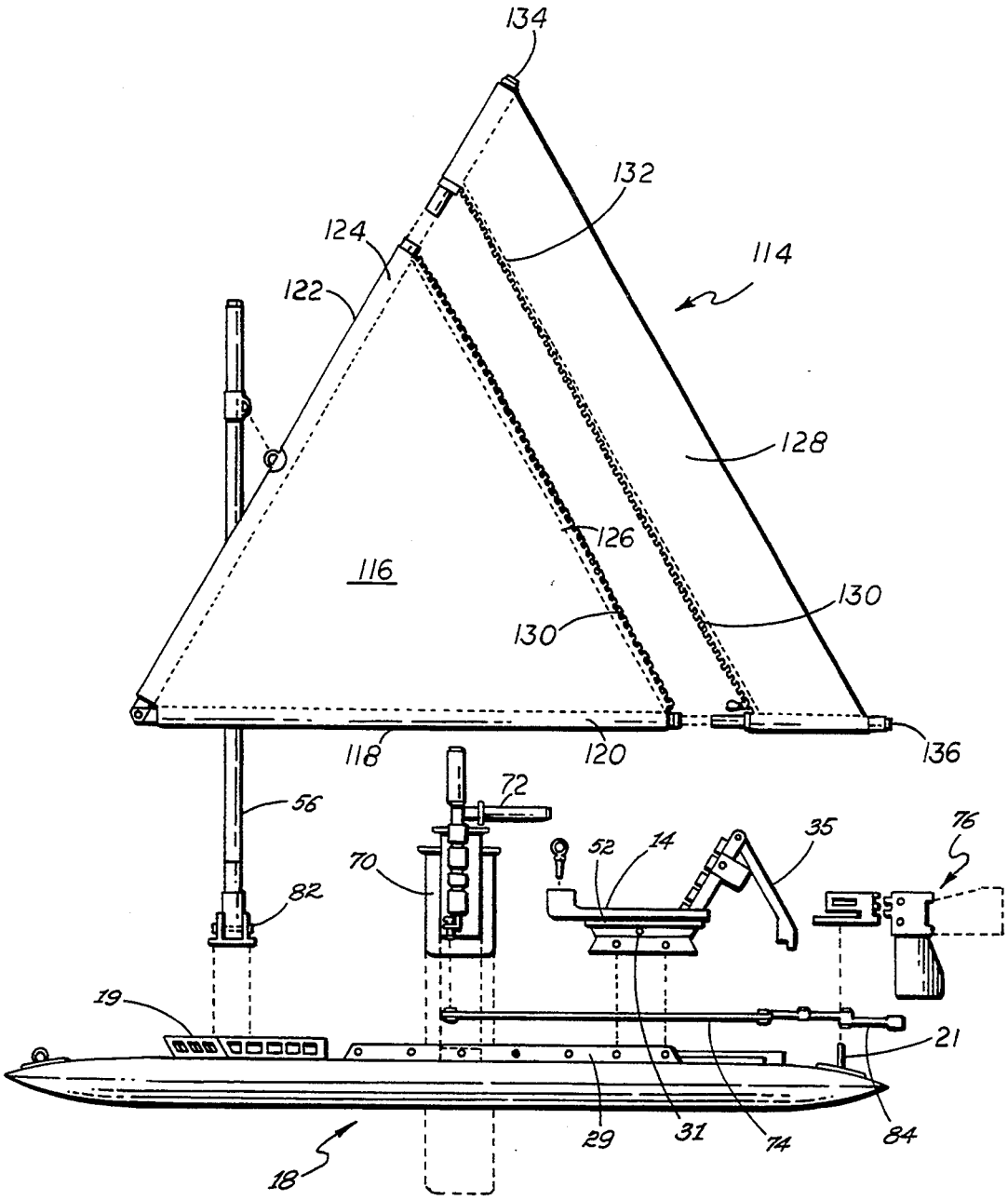
FIG. 14 is an exploded view of the sail board of FIG. 4 and sail of FIG. 15 constructed according to the present invention with constituent assemblies shown separately.
Figure 15:
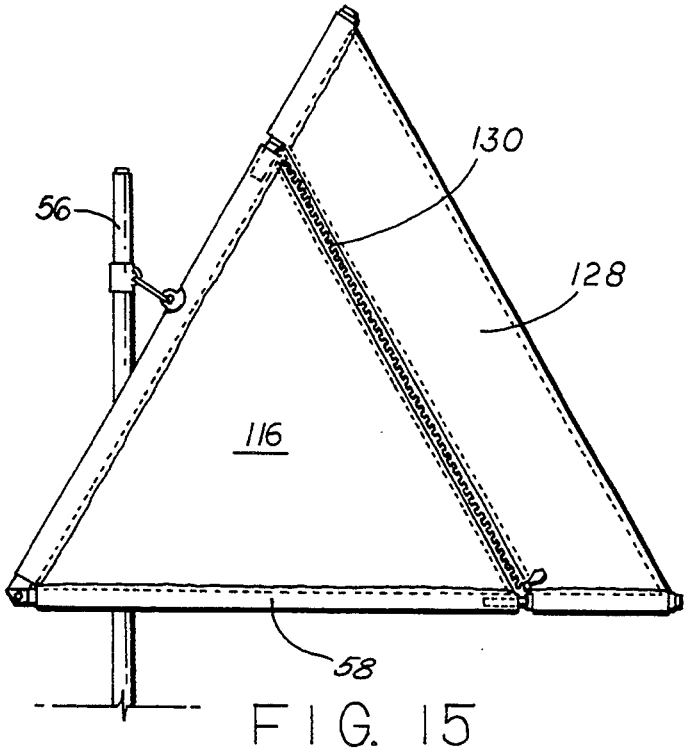
FIG. 15 is an enlarged side view of an alternate embodiment of a mast and sail of the sailing craft of the present invention showing a reefing zipper line.
Figure 16:
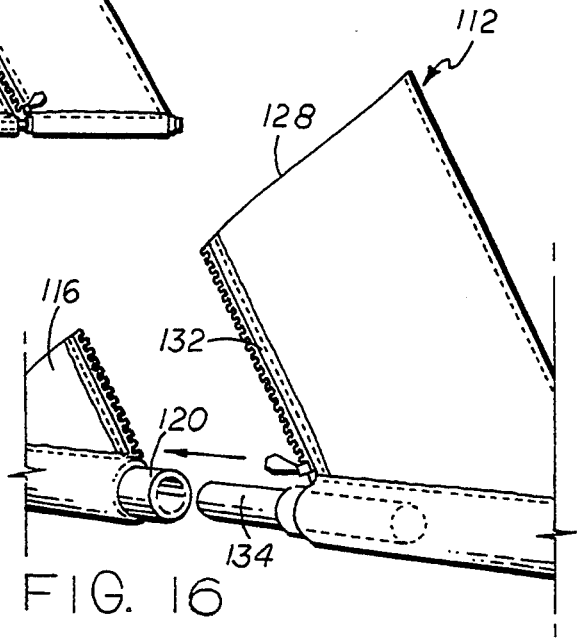
FIG. 16 is an enlarged fragmentary view of the sail board of FIG. 15 showing a detachable spar device.
Figure 17:
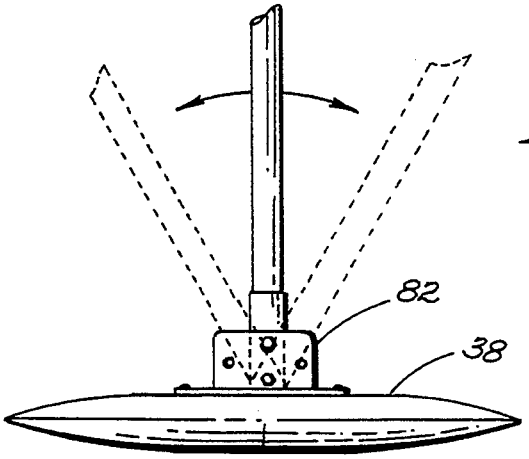
FIG. 17 is an enlarged longitudinal cross sectional view of a mast and stepping device of the sail board of FIG. 4 taken along lines 10—10.
Figure 18:
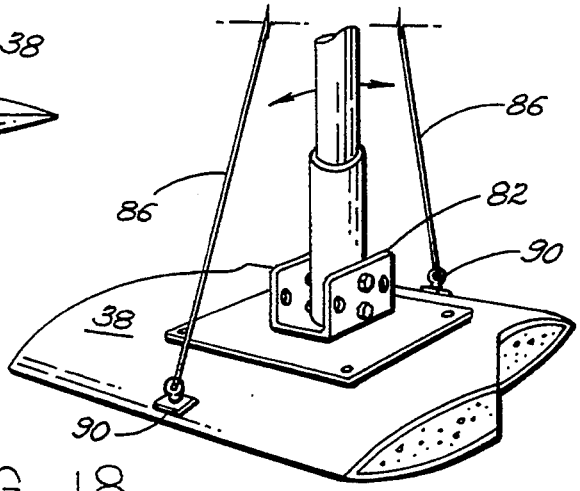
FIG. 18 is an enlarged fragmentary view of the mast and stepping assembly of FIG. 14.
Figure 19:
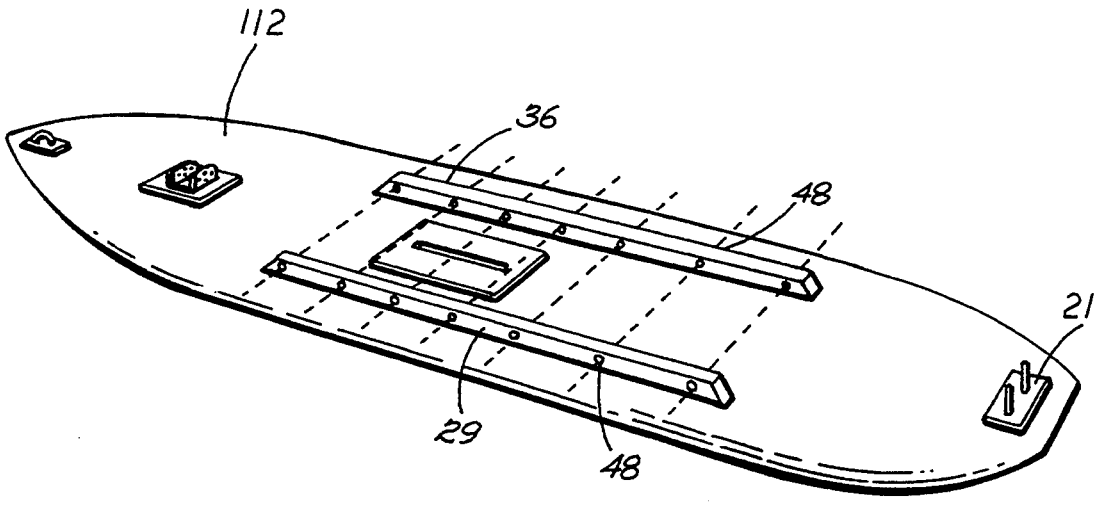
FIG. 19 is an elevational view from above the invention of FIG. 1 showing a conventional sail board stripped of sail board accessories.

The sail board 12 is shown in FIGS. 1, 4 and 14 and consists of a hull 40 having a bow end and a stern end and including a bow rail 19 mounted on the forward portion of the deck surface 38 for diverting water from said deck surface, a chassis 36 and a rudder mounting device 21. The chassis 36 consists of a pair of rails 29 shown in FIGS. 5 and 19 each rail having a series of sockets 48 and includes a foot rest extending between the forward ends of said rails.

The sailing kit 24, the rowing kit 26, and the paddling kit together form a watercraft conversion assembly 16 which permits a user to convert the sail board 12 selectively into a sailing craft 10, said rowing craft 20 or said paddling craft 22.

Figure 3:
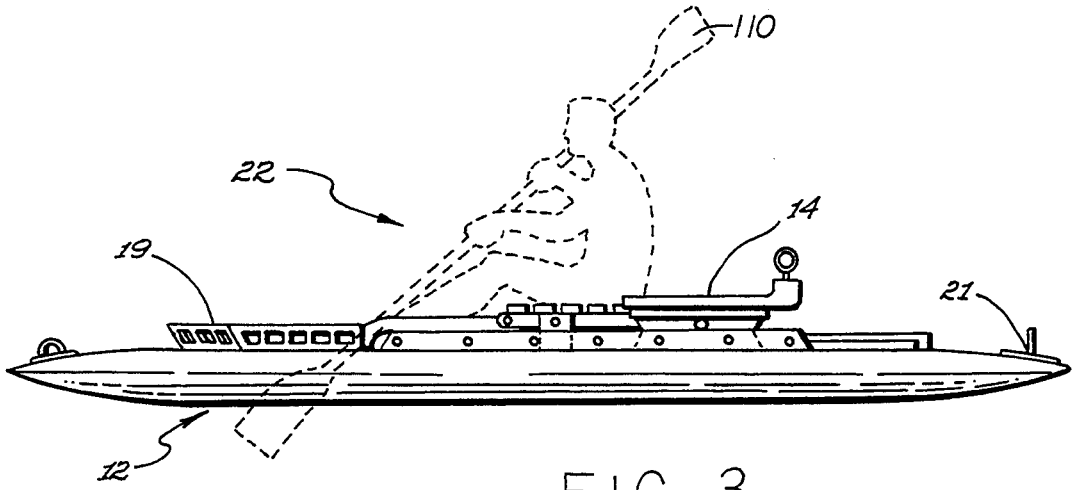
FIG. 3 is a side view of a paddling craft which is an alternate embodiment of the present invention employing a sail board with seat system, shown in the forward facing kayak mode.
Figure 11:
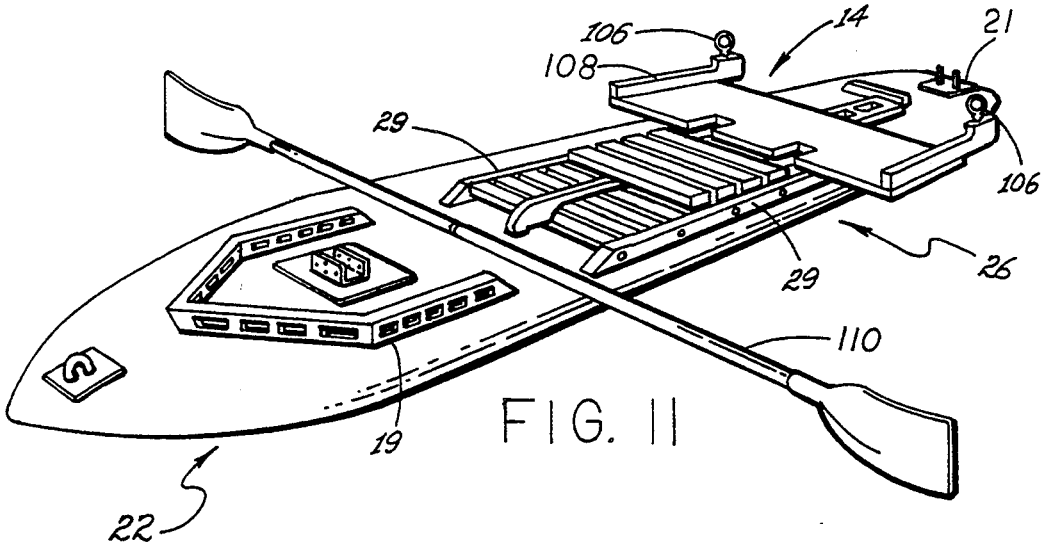
FIG. 11 is an elevational view from above of the paddling craft of FIG. 3 which is an alternate embodiment of the present invention.
Figure 12:
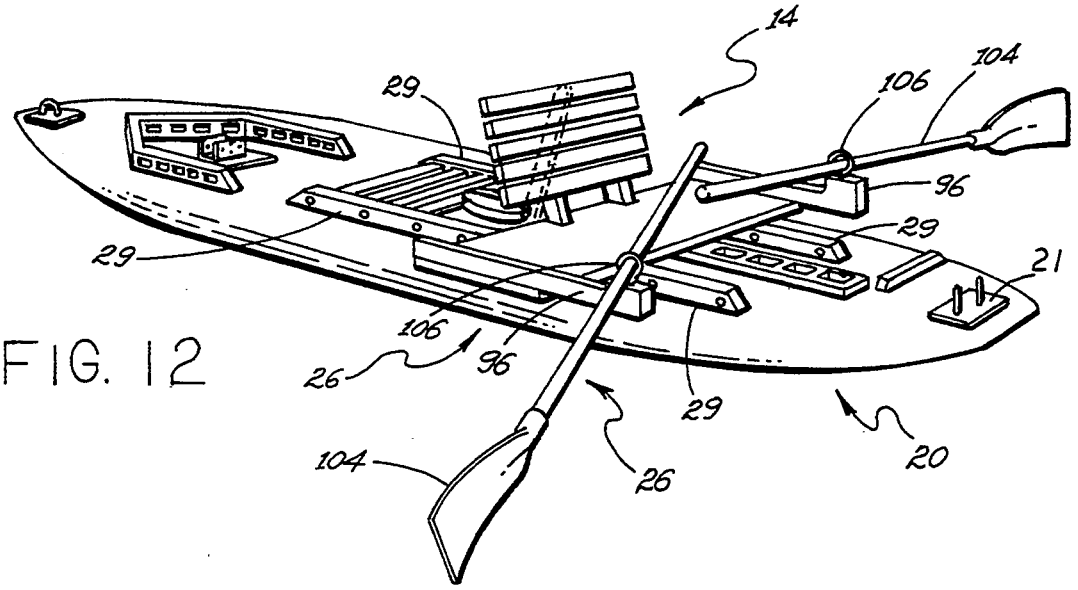
FIG. 12 is an elevational view form above of the rowing craft of FIG. 2 of the present invention.

In the preferred embodiment, the seat system 14 is configured to be arranged in different positions including a plurality of forward-facing positions for sailing shown in FIGS. 1 and 2, a plurality of rear facing positions that is longitudinally spaced for rowing shown in FIGS. 2 and 12 and a forward-facing position for paddling shown in FIGS. 3 and 11. Said seat system consists of a platform 32 extending transversely across the chassis 36 having a base 31 configured for sliding association with a tubular member 33. A back support 32 is hingedly attached to the chassis 36 having pins 46 mounted in the base thereof for selective insertion in a pair of sockets 48 for longitudinally positioning the back rest 35 with respect to the chassis 36. Said seat system is connected to the sail board 12 by fastening the chassis 36 to the deck surface 38.

In the preferred embodiment, the seat system 14 is configured to be arranged in a plurality of longitudinally arranged positions and the back support 34 pivotally mounted at one end of said platform. The sail board 12 and seat and seat system 14, which is common to each of the three watercraft conversion kits 20, 22 and 24, consists of a board like hull 40 having said deck surface 38, a bow 42 and a stern 44. In the present invention said sail board is a conventional board with wind surfing accessories removed (not shown) such as a dagger board, a rear fin and a typical wind surfing hinged fastening apparatus for attaching a mast to the sail board. The sail board typically is a "fun board". The seat system 14 consists of said multi-positional seat having said associated back support 34, movably mounted by at least two pins 46 received in sockets 48 in the chassis 36.

In the present invention the chassis 36 is attached to the deck surface 38 of said sail board to which a base 31 attached to the bottom of platform 32 is connected by said pins. Included in the platform 32 a tube rest 51 at the forward end of the chassis 36 and a hiking tubular member 52 connected to the base 31 for movement of said platform in an axis perpendicular to the longitudinal axis of said sail board.

Figure 5:
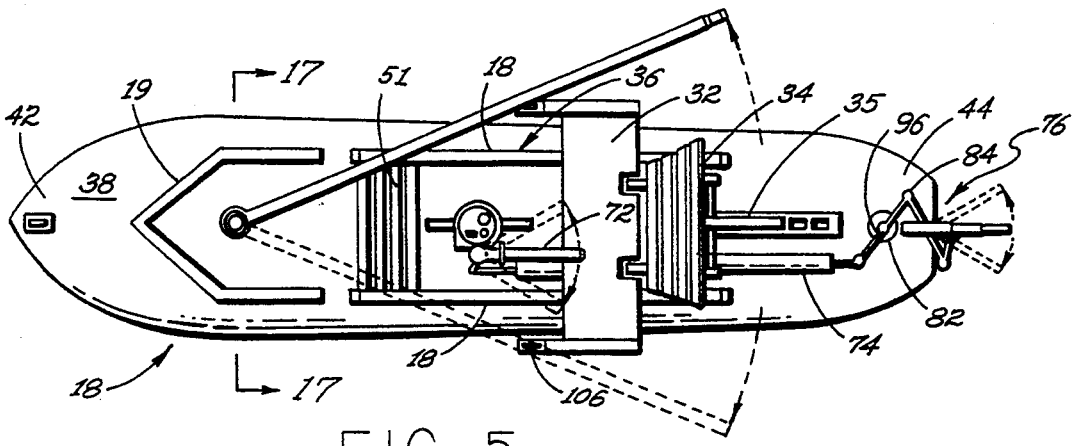
FIG. 5 is a top plan view of the sail board with seat system in a sail-craft arrangement in accordance with the present invention of FIG. 4
Figure 6:
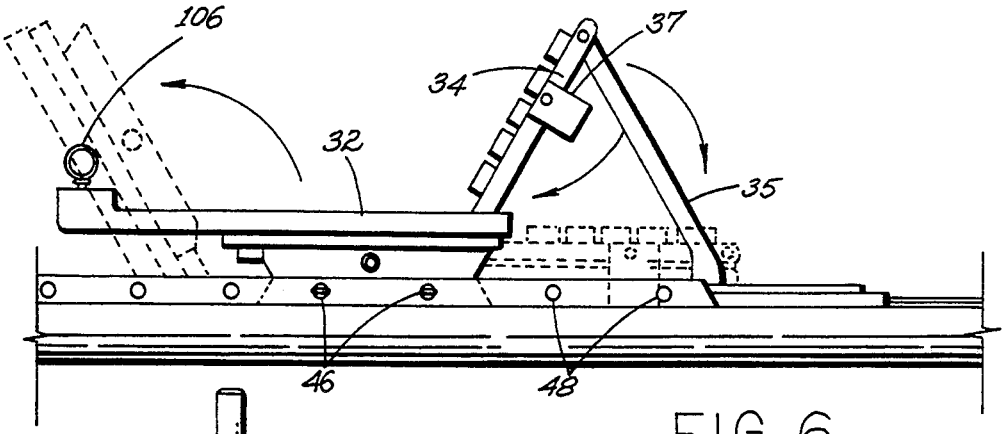
Figure 8:
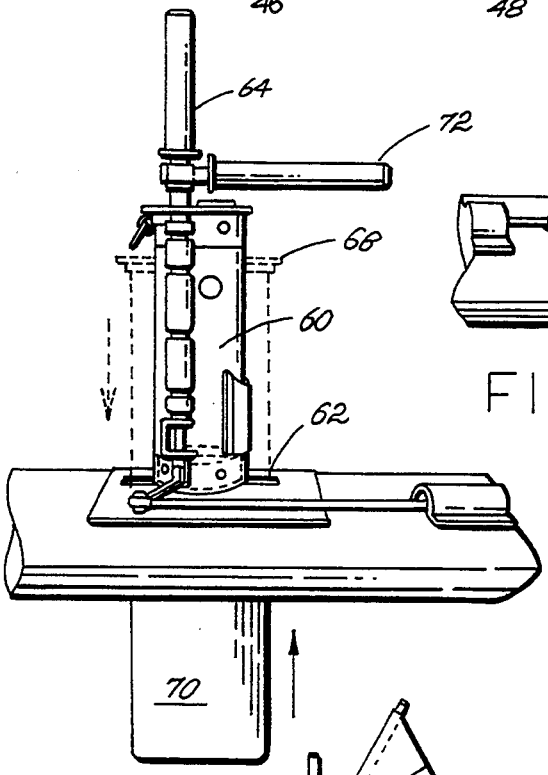
FIG. 8 is an enlarged fragmentary view of the sail board of FIG. 4 showing a pedestal console of the invention of FIG. 1.
Figure 7:
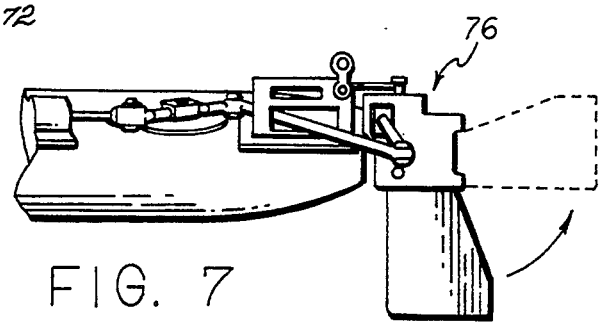
FIG. 7 is a enlarged fragmentary view of the sail board of FIG. 4 showing a stern, a steering mechanism and rudder mechanism of the sail board of FIG. 1.
Figure 9:
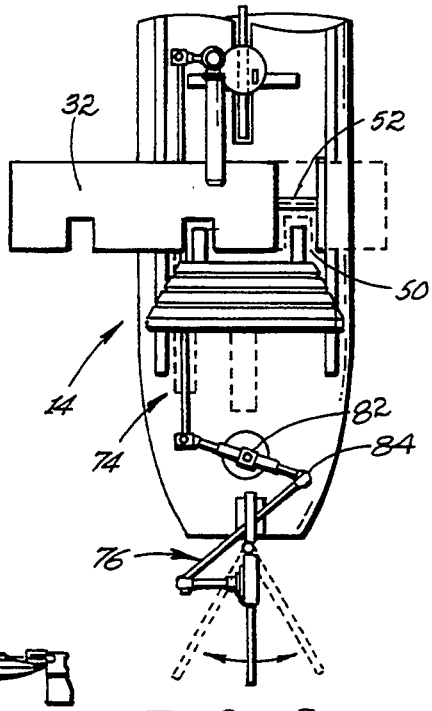
FIG. 9 is an enlarged fragmentary top plan view of the sail board of FIG. 4 showing the stern section with the steering mechanism connecting the rudder mechanism with the pedestal console.
Figure 10:
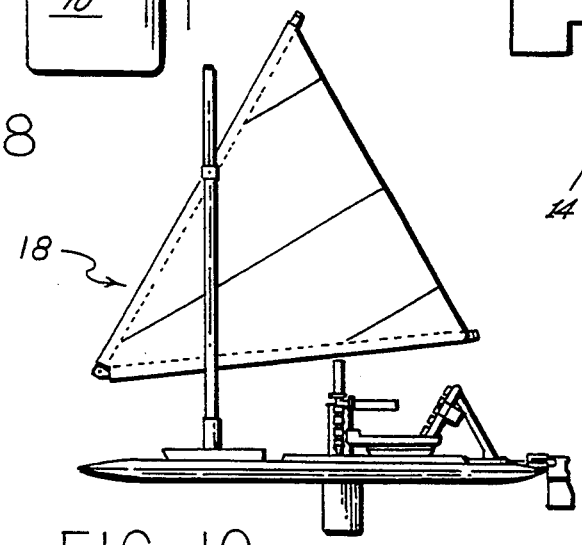
FIG. 10 is a side elevational view of an alternate embodiment of the sailing craft of the present invention showing a lateen sail.

In the preferred embodiment, the invention is directed to the combination of the sail board 12 and a seat system 14 with the sailing kit 24 portion of the watercraft conversion assembly 16. The sailing kit 24, as is seen in FIG. 4, consists of a sail 54, a jib 55, a mast 56 for supporting said sail and jib, a boom 58 movably connected to the foot of the mast together with a pedestal console assembly 60. Said pedestal console in positioned in association with a conventional dagger board well 62, seen in FIG. 8, of the sail board 12. Mounted on said pedestal console are steering means 64 for controlling steering of the craft by a hand operated steering apparatus, sail control means 66 for controlling the sail by hand and a dagger board control means 68 for operating the dagger board 70 by hand. As is shown in FIG. 1, 2 and 5, a hand operated tiller 72 is connected by shafting apparatus 74 to a rudder mechanism 76 attached to the stern end 44 for steering the sailing craft 18. Tackle means for rigging the sail is provided consisting of a halyard rope means 78 and main sheet means 80 including conventional tackle and pulleys.

The tiller 72 is mounted on the pedestal console 60 and is connected to a shafting device 74 extending rearward to the rudder mechanism 76 configured for manual operation of said rudder mechanism for steering the sail board 12 when in motion. The mast 56 is mounted on a semi-rigid tilting step 82 fastened to the deck surface 38. The main sheet 80 is connected to the boom 58. The rudder mechanism 76 is attached to the stern 44 by a gudgeon shaft 82 connected to a transverse arm 84 connected by said shafting to the said tiller mounted on a said pedestal console.

Figure 13:
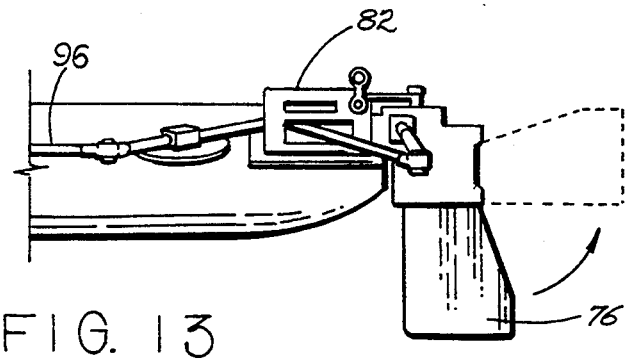
FIG. 13 is an enlarged fragmentary side view of the sail board of FIG. 1 showing the rudder mechanism mounted on the stern end.

In the preferred embodiment, the seat system 14 is adjusted by rotating the back support 34 through an arc, said back rest being pivotally mounted on the chassis 36 by pins 46 such that the sailor is positioned facing forward. In the sailing mode, the chassis 36 is adjusted to be in a preset longitudinal position as shown in FIG. 1 being locked in place on a pair of rails 29 by pins 46 fitted in one of a series of sockets 48. A pair of shrouds 86 support the mast 56 in a generally vertical position with releasable turnbuckle 90 attached to each side of hull 40. In this embodiment, the rudder mechanism 76 includes a retractable rudder 92, shown in FIG. 13, mounted on the a gudgeon shaft 82 connected to an actuating arm 94 having an aft end and a forward end. The actuating arm 94 is connected to a lever arm 96 attached to the base of a tiller post 98 mounted on the pedestal console 60. The tiller 72, is connected to the tiller post 98, said tiller post being rotably mounted on the port side of said pedestal console in on sleeve devices 100 to permit axial rotation about a vertical axis, there being a horizontally extending tiller handle 102 fastened to the terminal end of said tiller post.

In an alternate embodiment, the sail board may be converted into a rowing craft 20 by employment of the rowing kit 26 included in the watercraft conversion assembly 16. In this embodiment, the invention is directed to a conversion arrangement for sail board 12 with seat system 14 by the rowing kit 26 for converting the sail board 12 into said rowing craft. In this embodiment, the seat system 14 is moved to the rowing position wherein a pair of oars 104 is provided with each oar to be positioned respectively in an oar lock 106 with each oar lock fastened to a outrigger beam 96 attached to the platform 32. In the rowing craft mode, the multi-positional seat 30 is shifted with the back support 34 in the forward position and the hiking slide 52 being locked in a mid position and the chassis 36 in the slide position.

An alternate embodiment of the invention is directed to a paddling craft conversion arrangement for the sail board 12 with multi-positional seat 30 by application of the paddle kit 28 portion of the conversion arrangement assembly 16. The employment of said paddling kit converts said sail board into said paddling craft wherein the multi-positional seat 30 is placed in the paddling position wherein said seat is positioned with the back support 34 in the aft position and said seat locked on the chassis 36 in mid position and user is placed in a forward facing position. Paddling is provided by a conventional kayak paddle device 110.

In a further embodiment of the invention, the sail includes a conversion arrangement 112 for the sail board 10 with seat system 14 by application of a sail reef kit 114. This sail kit provides a means of reefing or shortening a sail constructed in a lateen configuration. The sail kit consists of a triangular sail 116 having a bottom edge 118 connected to a bottom boom 120 and a top edge 122 connected to a top boom 124, a free edge 126 typically called a leech, a reef member 128 attached to the free edge by a zipper 130, wherein the top boom 124 is connected to the mast 78 of the sail board by a halyard member 130 and the bottom boom 120 is connected by a sheet means 80 to the pedestal console 60. In this embodiment, the reef member 128 consists of a truncated panel of sail material including a zipper track 132 on an inner edge having a top and bottom end said ends being supported by boom extension members 134 consisting of a first extension post adapted to engage the end of the top boom 124 and a second extension post 136 adapted to engage the end of the bottom boom 120.

What is claimed is:

1. A multi-functional accessory arrangement for converting a sail board into a paddling craft, rowing craft or conventional sailing craft comprising:

a) hull means comprising a sail board having a deck a forward bow end, an aft stern end, a longitudinal axis extending between said bow end and stern end, and a centerboard well;

b) a detachable, multi-functional seat with moveable back including an associated back support, adapted to be adjustable between a forward facing sailing position, an aft facing rowing position and a forward facing paddling position;

c) a chassis extending along said longitudinal axis attached to the deck for engaging said multi-functional seat permitting selective positioning of said seat on said longitudinal axis of the sail board;

d) watercraft conversion assembly means for propelling the sail board comprising a sailing subassembly, a rowing subassembly and a paddling subassembly;

e) steering means for manually steering the sail board when in motion;

f) pedestal means for controlling the movement of the sail board including a centerboard, a tiller means for controlling the rudder and rigging means for controlling the sail comprising halyard means and sheet means;

g) rowing fixture means including locks attached to the chassis;

h) step means positioned forward of the centerboard well for stepping a mast; and i) rudder post means positioned aft of the chassis for mounting a steering means wherein stability is provided by utilizing the larger size conventional sail board assembly hulls as a hull to which can be attached to the multi-functional seat arranged in combination with one of said water craft conversion means for converting the sail board selectively into either a conventional sailing craft that is designed to be operated from a forward-facing seated position, a row boat that is arranged to be operated from an aft-facing seated position with oars or a paddling craft wherein the user is oriented in a forward-facing seated position.

2. The multi-functional accessory arrangement of claim 1 wherein the sailing subassembly comprises:

a) sail of triangular configuration having a top edge connected to a top boom and a bottom edge connected to a bottom boom support and a free edge;

b) a mast mounted on the stepping means;

c) steering means for manually steering the sail board when in motion comprising a rudder mounted on a retractable rudder means connected by rudder linkage means to a tiller means; and d) pedestal means for controlling the movement of the sail board including a centerboard, a tiller means for controlling the steering means and rigging means comprising a halyard means for raising the sail and a sheet means for controlling the sail.

3. The multi-functional accessory arrangement of claim 1 wherein the rowing subassembly comprises a pair of oars configured to associate with the locks fastened to an outrigger beam attached to the platform of the multi-functional seat, the back support is placed in the forward position, the hiking slide is locked in a mid position and the multi-functional seat is moved to the aft-facing rowing position on the chassis and fastened in place with pins.

4. The multi-functional accessory arrangement of claim 1 wherein employment of the paddling subassembly converts said sail board into a paddling craft wherein the multi-positional seat is positioned with the back support rest in the aft position and said seat is locked on the chassis in mid position and user is placed in a forward facing seated postion and paddling is provided by a conventional kayak paddle device.

5. The multi-functional seat and sail board assembly of claim 4 wherein the sail means includes a main halyard means for raising and lowering the sail on a mast mounted on a semi-rigid step means that is moveable between a starboard position, a mid position and a port position, a main sheet means connected to a boom and to a pedestal means and a steering means comprised of a rudder mounted on the stern of the sailing craft connected by actuation means to a tiller mounted on the pedestal means.

6. The combination seat and sail board assembly apparatus of claim 4 wherein the mast is supported on a stepping means comprised of a plate means permitting angular movement of the mast between a port position, a mid position, a second mid position and a third starboard position as selected by the user responsive to varying wind conditions acting on the sail.

7. The multi-functional accessory arrangement of claim 1 wherein the chassis comprises a hiking tube device for permitting the user to hike out laterally for counter balancing heeling of the hull responsive to the action of wind acting on the sail.

8. The multi-functional accessory arrangement of claim 1 wherein an alternate sail subassembly provides a means of reefing or shortening the sail comprising a triangular sail having a bottom edge connected to a bottom boom and a top edge connected to a top boom and a free edge, a reef member attached to said free edge by a zipper, wherein the top boom is connected to the mast of the sail board by a halyard member and said reef member consists of a truncated panel of sail material including a zipper track on an inner edge having a top and bottom end said ends being supported by boom extension members, and including extension members comprising of a first extension post adapted to engage the end of the top boom and a second extension member adapted to engage the end of the bottom boom.

9. The combination seat and sail board assembly of claim 1 wherein the steering means is configured for use in combination with the sailing apparatus and comprises a retractable rudder mounted on a retractable gudgeon means that is connected to an actuating arm having an aft end and a forward end said actuating arm is connected to the lever arm attached to the base of a tiller mounted on the pedestal and the tiller has a vertical shaft on which is movable fastened a horizontally extending handle means wherein movement of the handle through a transverse arc causes a corresponding movement of the rudder turning on the gudeon shaft in a corresponding transverse arc.

10. A hull seat arrangement for converting a sail board assembly into a sailing craft comprising:

a) a hull comprising a sail board assembly having an deck and a bottom hull surface, a bow end, a stern end, and having a longitudinal axis extending therebetween, a dagger board well at a mid position on the hull along said longitudinal axis; and a transverse or athwartships axis an aft stern end;

b) seat means movably mounted on the hull for movement both along the longitudinal axis and a orthogonically oriented transverse axis comprising a platform for sitting positioned parallel to the deck and having an associated back support hingedly connected to one end of the platform, adapted to be moved through an arc between an aft tilted position for forward facing and a forward tilted position for aft facing, and including a brace for bracing the back in place;

c) chassis means for movably connecting the seat means on the deck permitting reciprocal movement of said seat along the longitudinal axis of the hull between a forward position and an aft position including hiking means for moving the seat perpendicularly to the longitudinal axis;

d) sail means for providing propulsion for the hull comprising a sail, a mast, a boom and sheet rigging for arranging the sail in relation to the wind for heading up wind and off the wind;

e) pedestal means for directing the movement of the sail board assembly craft from a sitting position by controlling steering, trimming of the sail and positioning the centerboard;

f) steering means for manually steering the sail board assembly comprising a tiller connected by shafting to a rudder;

g) step means for adjustably stepping the mast; and h) shroud means for adjustably supporting the mast when tacking into and away from the wind to be inclined athwartships in a plurality of inclined positions wherein the sail board assembly is converted to a sailboat configured to be operated from the seated position facing forward.

* * * * *